US010112808B2

(12) United States Patent
Fretz et al.

(10) Patent No.: US 10,112,808 B2
(45) Date of Patent: Oct. 30, 2018

(54) WINCH

(71) Applicant: Warn Industries, Inc., Clackamas, OR (US)

(72) Inventors: Darren G. Fretz, Oregon City, OR (US); Bryan M. Averill, Portland, OR (US); Steven W. Shuyler, Clackamas, OR (US); Bryon M. Borntrager, West Linn, OR (US); Kyle A. Hartelt, Portland, OR (US); Glenda M. Steele, Milwaukie, OR (US)

(73) Assignee: WARN INDUSTRIES, INC., Clackamas, OR (US)

( * ) Notice: Subject to any disclaimer, the term of this patent is extended or adjusted under 35 U.S.C. 154(b) by 461 days.

(21) Appl. No.: 14/972,058

(22) Filed: Dec. 16, 2015

(65) Prior Publication Data

US 2016/0167935 A1 Jun. 16, 2016

Related U.S. Application Data

(63) Continuation of application No. 13/774,746, filed on Feb. 22, 2013, now Pat. No. 9,266,702.

(Continued)

(51) Int. Cl.
*B66D 1/14* (2006.01)
*B66D 1/36* (2006.01)

(Continued)

(52) U.S. Cl.
CPC ..... *B66D 1/14* (2013.01); *B66D 1/02* (2013.01); *B66D 1/12* (2013.01); *B66D 1/22* (2013.01);

(Continued)

(58) Field of Classification Search
CPC ... B66D 1/02; B66D 1/12; B66D 1/14; B66D 1/22; B66D 1/28; B66D 1/36; B66D 1/40; B66D 5/00
See application file for complete search history.

(56) References Cited

U.S. PATENT DOCUMENTS 325,616 A 9/1885 Lyons
551,141 A 12/1895 McNutt (Continued)

FOREIGN PATENT DOCUMENTS

CA 1107710 A 8/1981
CN 101273511 A 9/2008

(Continued)

OTHER PUBLICATIONS

"Viking Winch GS-9," Viking Offroad Website, Available Online at http://www.vikingoffroad.com/viking-winch-gs-9/, Available as Early as Feb. 2013, 2 pages.

(Continued)

*Primary Examiner* — Michael E Gallion
(74) *Attorney, Agent, or Firm* — K&L Gates LLP

(57) ABSTRACT

A winch includes a motor having a motor housing including a motor case and an integrated first drum support attached to the motor case for closing an end of the motor case. A gear reduction unit is drivingly attached to the motor and has a gear housing including a gear case and second drum support attached to the gear case. A tie plate is connected to the first and second drum supports. A control unit is removably mounted to the tie plate. A rotatable drum is supported by the first and second drum supports.

19 Claims, 13 Drawing Sheets

Related U.S. Application Data

(60) Provisional application No. 61/665,952, filed on Jun. 29, 2012.

(51) Int. Cl.

| | |
|---|---|
| ***B66D 1/40*** | (2006.01) |
| ***B66D 1/02*** | (2006.01) |
| ***B66D 1/12*** | (2006.01) |
| ***B66D 1/22*** | (2006.01) |
| ***B66D 1/28*** | (2006.01) |
| ***B66D 5/00*** | (2006.01) |

(52) U.S. Cl.
CPC ..... *B66D 1/28* (2013.01); *B66D 1/36* (2013.01); *B66D 1/40* (2013.01); *B66D 5/00* (2013.01)

(56) References Cited

U.S. PATENT DOCUMENTS

| | | | | |
|---|---|---|---|---|
| 1,550,114 | A | 8/1925 | Simpson | |
| 3,048,369 | A | 8/1962 | Hanson | |
| 3,070,355 | A | 12/1962 | Wyatt | |
| 3,072,384 | A | 1/1963 | Apichell | |
| 3,190,617 | A | 6/1965 | Burrows | |
| 3,392,926 | A * | 7/1968 | Adams | B66D 1/14 254/276 |
| 3,645,503 | A | 2/1972 | Doerfling | |
| 3,764,020 | A | 10/1973 | Batson | |
| 3,986,588 | A | 10/1976 | Kuzarov | |
| 4,123,040 | A | 10/1978 | Kuzarov | |
| 4,185,520 | A | 1/1980 | Henneman et al. | |
| 4,331,323 | A | 5/1982 | Sekimori et al. | |
| 4,461,460 | A | 7/1984 | Telford | |
| 4,552,340 | A | 11/1985 | Sheppard | |
| 4,650,163 | A | 3/1987 | Peterson | |
| 4,656,409 | A | 4/1987 | Shimizu | |
| 4,736,929 | A | 4/1988 | McMorris | |
| 4,846,090 | A | 7/1989 | Palmquist | |
| 5,098,068 | A | 3/1992 | Jussila | |
| 5,343,581 | A | 9/1994 | Bartley et al. | |
| 5,374,035 | A | 12/1994 | Santos | |
| 5,398,923 | A | 3/1995 | Perry et al. | |
| 5,495,995 | A | 3/1996 | Dominique et al. | |
| 5,522,582 | A * | 6/1996 | Dilks | B66D 1/00 242/587.2 |
| 5,663,541 | A * | 9/1997 | McGregor, II | H01H 1/20 200/17 R |
| 6,129,193 | A | 10/2000 | Link | |
| 6,152,425 | A | 11/2000 | Boyer | |
| 6,494,437 | B1 | 12/2002 | Boyer | |
| D473,992 | S | 4/2003 | Hodge | |
| 6,595,495 | B1 | 7/2003 | Hung | |
| 6,601,828 | B2 | 8/2003 | Strbuncelj et al. | |
| 6,663,086 | B2 | 12/2003 | Huang | |
| D489,157 | S | 4/2004 | Lawson | |
| 6,794,790 | B2 | 9/2004 | Kusase et al. | |
| 7,000,904 | B2 | 2/2006 | Huang | |
| 7,028,989 | B2 | 4/2006 | Flynn et al. | |
| 7,261,277 | B2 | 8/2007 | Copeman | |
| 7,434,786 | B2 | 10/2008 | Voegeli, Jr. | |
| D599,524 | S | 9/2009 | Averill et al. | |
| 7,588,233 | B2 | 9/2009 | Roe et al. | |
| 7,614,609 | B1 | 11/2009 | Yang et al. | |
| 7,703,751 | B2 | 4/2010 | Elliott et al. | |
| 7,789,374 | B2 | 9/2010 | Averill et al. | |
| 7,806,386 | B2 | 10/2010 | Yang et al. | |
| 7,891,641 | B1 | 2/2011 | Miller | |
| 7,913,978 | B1 * | 3/2011 | Trihey | B66D 3/006 254/323 |
| 7,922,153 | B2 * | 4/2011 | Zhou | B66D 1/22 254/323 |
| D640,442 | S | 6/2011 | Borntrager et al. | |
| 8,006,958 | B2 * | 8/2011 | Starks | B66D 3/20 254/323 |
| 8,299,667 | B2 | 10/2012 | Isoda et al. | |
| 9,120,656 | B2 * | 9/2015 | Yoder | B66D 1/34 |
| 9,266,702 | B2 * | 2/2016 | Fretz | B66D 1/02 |
| 9,315,364 | B2 * | 4/2016 | Averill | B66D 1/12 |
| 9,415,981 | B2 * | 8/2016 | Heravi | B66D 1/42 |
| 2001/0050346 | A1 | 12/2001 | Fujita et al. | |
| 2002/0105242 | A1 | 8/2002 | Takahashi et al. | |
| 2003/0001147 | A1 * | 1/2003 | Kiviniitty | B66D 1/12 254/342 |
| 2003/0107030 | A1 | 6/2003 | Sozzi | |
| 2005/0073206 | A1 | 4/2005 | Wilsdorf | |
| 2005/0269886 | A1 | 12/2005 | Harris | |
| 2007/0221898 | A1 * | 9/2007 | Giacomini | B66D 1/08 254/323 |
| 2007/0267613 | A1 | 11/2007 | Alipour et al. | |
| 2008/0001132 | A1 * | 1/2008 | Huang | B66D 1/12 254/362 |
| 2008/0061276 | A1 * | 3/2008 | Averill | B66D 1/22 254/323 |
| 2008/0099738 | A1 | 5/2008 | Burns | |
| 2008/0224110 | A1 * | 9/2008 | Starks | B66D 3/20 254/264 |
| 2009/0255186 | A1 | 10/2009 | Uchimura | |
| 2009/0309082 | A1 | 12/2009 | Webb et al. | |
| 2010/0006808 | A1 * | 1/2010 | Weingartner | B66D 3/26 254/372 |
| 2010/0007218 | A1 | 1/2010 | Ogram | |
| 2010/0065799 | A1 * | 3/2010 | Zhou | B66D 1/22 254/344 |
| 2013/0076173 | A1 | 3/2013 | Fisher et al. | |
| 2018/0118529 | A1 * | 5/2018 | Vaughn | B66D 1/16 |
| 2018/0127246 | A1 * | 5/2018 | Fretz | B66D 1/28 |

FOREIGN PATENT DOCUMENTS

| | | | |
|---|---|---|---|
| CN | 101381059 | A | 3/2009 |
| CN | 201367323 | Y | 12/2009 |
| WO | 2008026503 | A1 | 3/2008 |

OTHER PUBLICATIONS

Canadian Patent Office, Office Action Issued in Canadian Patent Application No. 2,814,058, dated Mar. 4, 2014, 3 pages.
Canadian Patent Office, Office Action Issued in Canadian Patent Application No. 2,814,058, dated Jan. 22, 2015, 4 pages.
IP Australia, Office Action Issued in Australian Patent Application No. 2013205829, dated Mar. 6, 2015, 3 pages.
IP Australia, Office Action Issued in Australian Patent Application No. 2013205829, dated Jul. 24, 2015, 3 pages.
State Intellectual Property Office of the People's Republic of China, Office Action and Search Report Issued in Application No. 201610282619.5, dated Sep. 21, 2017, 13 pages. (Submitted with Partial Translation).

* cited by examiner

WINCH

CROSS REFERENCE TO RELATED APPLICATIONS

The present application is a continuation of U.S. patent application Ser. No. 13/774,746, entitled "Winch," filed on Feb. 22, 2013, which claims the benefit of U.S. Provisional Application No. 61/665,952, filed on Jun. 29, 2012, the entire contents of each of which are hereby incorporated by reference for all purposes.

FIELD

The present disclosure relates to a winch, and more particularly to improved assembly features for a winch.

BACKGROUND

Winches are commonly made using a motor attached to a first drum support and a transmission attached to a second drum support with a rotatable drum disposed between the first and second drum supports. Tie rods are used for connection between the first and second drum support. The motor is typically a self contained motor that is separate from the first drum supports. With these prior winch designs, the ornamental appearance and the structure of the winch was influenced by the appearance of the motor housing. Accordingly, it is desirable to provide a winch construction that is capable of being more aesthetically pleasing and that can include a low profile, improved sealing capability, alternative mounting arrangements for the controller and other assembly related improvements.

SUMMARY

A winch is provided having a motor with a motor housing including a motor case and a first drum support attached to the motor case for closing an end of the motor case. The motor includes a brush holder assembly attached to the first drum support as well as an armature terminal and field terminals attached to the first drum support. The first drum support includes an insulator block for electrically isolating the armature terminal and the field terminals from the drum support. The armature terminal and the field terminals are linearly aligned with one another to facilitate easy connection with a control unit. The motor includes an armature with a drive shaft and a brush plate disposed on a drive shaft side of the armature. The motor includes a flux ring clamped between the motor case and the first drum support and supported by a plurality of ribs which dissipate heat from the flux ring. The motor case and drum support can be made of aluminum to further improve heat dissipation. The motor also includes a brush plate having grounding screws that are connected to the first drum support.

A gear reduction unit is drivingly attached to the motor and has a gear housing including a gear case and a second drum support attached to the gear case for closing an end of the gear case. The gear case and the second drum support are shaped generally symmetric to the motor case and the first drum support in order to give the winch a generally symmetric appearance. A tie plate can be used to connect the first and second drum supports. The tie plate includes four corners with a mounting aperture in each of the four corners, each mounting aperture being aligned with one of a plurality of threaded bores in one of the first and second drum supports. The plurality of threaded bores each have a central axis that intersects an axis of rotation of the motor. A rotatable drum is drivingly connected to the motor and supported by the first and second drum supports.

A control unit can be mounted to the tie plate and can be removable so that it can optionally be mounted to another portion of a vehicle. The control unit can be electrically connected to the armature terminal and the field terminals by motor leads. A cover plate can be provided for covering the motor leads. The control unit can include a base plate detachably mounted to the tie plate. A contactor is mounted to the base plate in communication with the motor leads and a remote connector is mounted to the base plate and in communication with the contactor.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

Corresponding reference numerals indicate corresponding parts throughout the several views of the drawings.

DETAILED DESCRIPTION

Figure 1:
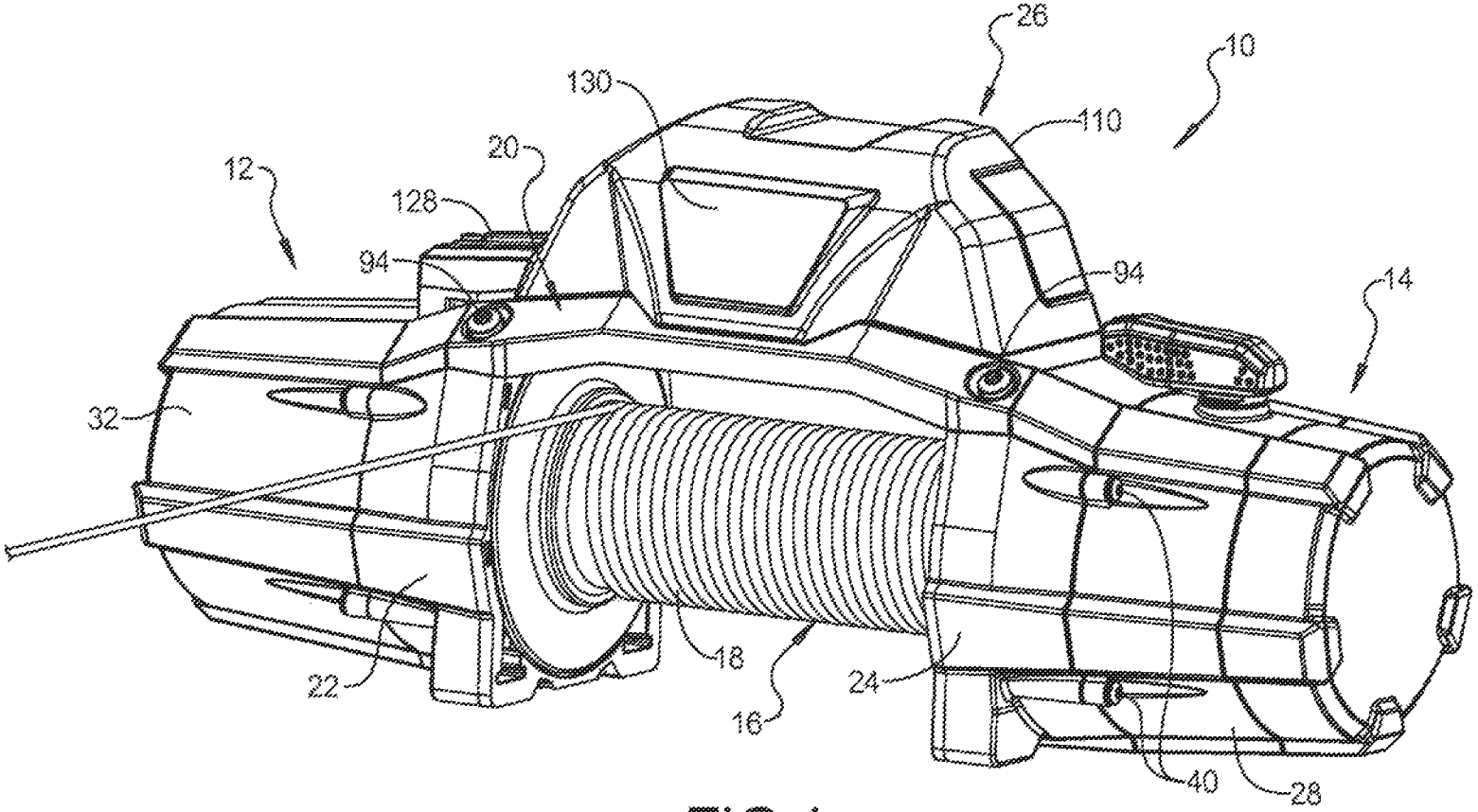
FIG. 1 is a perspective view of a winch according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a winch 10 according to the principles of the present disclosure will now be described. The winch 10 includes a motor assembly 12 drivingly connected to a gear reduction unit 14 which provides driving torque to a rotatable drum 16. A cable 18 can be wound onto, or off from, the rotatable drum 16 to provide various pulling operations. A tie plate 20 can be disposed for connection between a first drum support 22 of the motor assembly 12 and a second drum support 24 of the gear reduction unit 14. A control unit 26 can be removably mounted to the tie plate 20. The first drum support 22 is integrated with the motor assembly 12 in that it supports components of the motor and encloses the open end of the motor case 32, while also providing a bearing support structure for rotatably supporting the rotatable drum 16. Similarly, the second drum support 24 is integrated into the gear housing by supporting components of the gear reduction unit, and enclosing an open end of other gear case 28 while providing a bearing support structure for rotatably supporting the rotatable drum 16.

Figure 2:
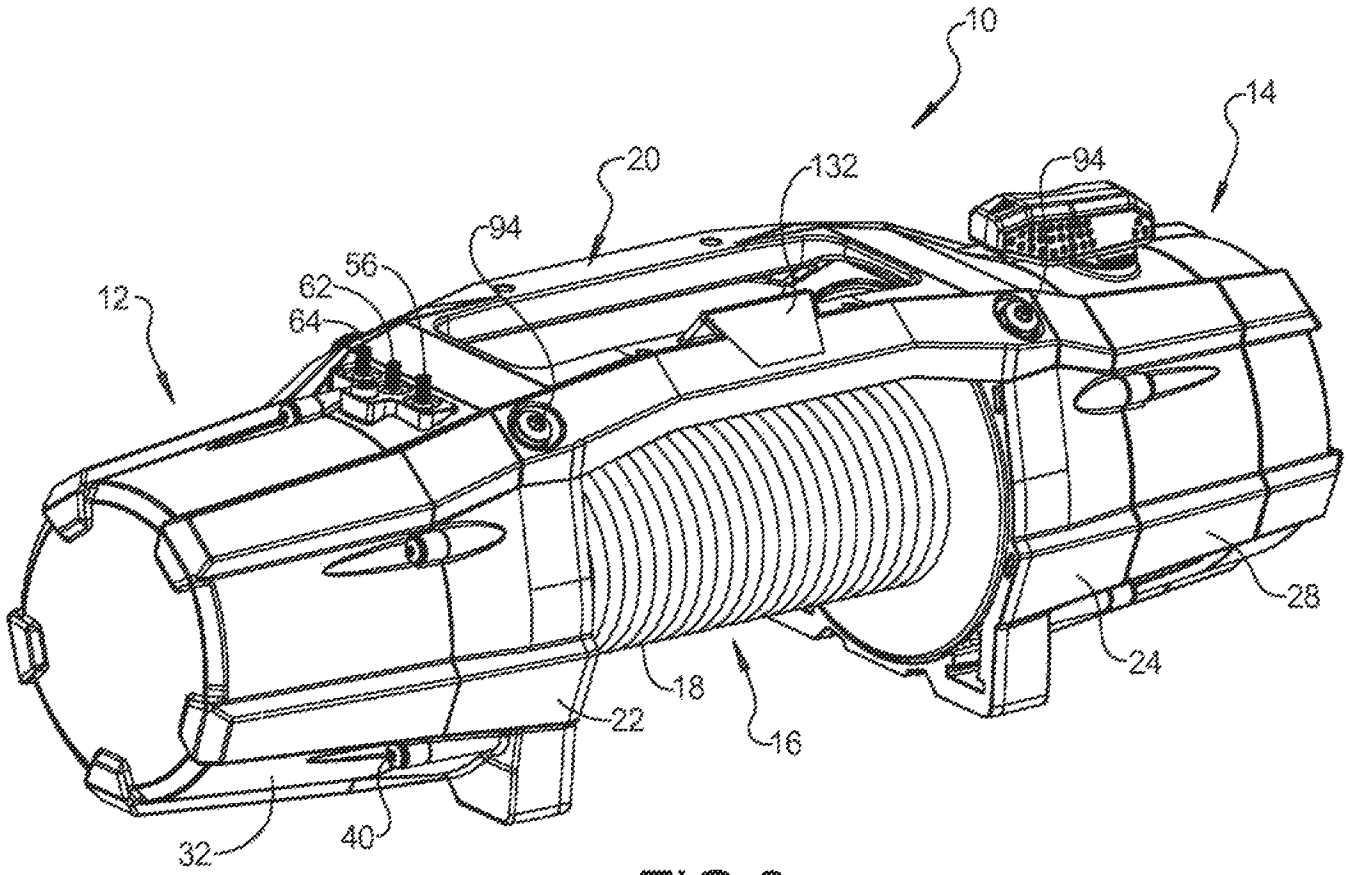
FIG. 2 is a perspective view of the winch of FIG. 1 with the control unit removed for mounting at a remote location.

FIG. 2 illustrates the winch 10 with the control unit 26 removed for providing the winch 10 with a lower profile, and the winch control unit 26 can be mounted to alternative surfaces of a vehicle such as the bumper, fender, or other interior or exterior surfaces of the vehicle with cables being provided for connecting the control unit 26 to the motor terminals.

Figure 6:
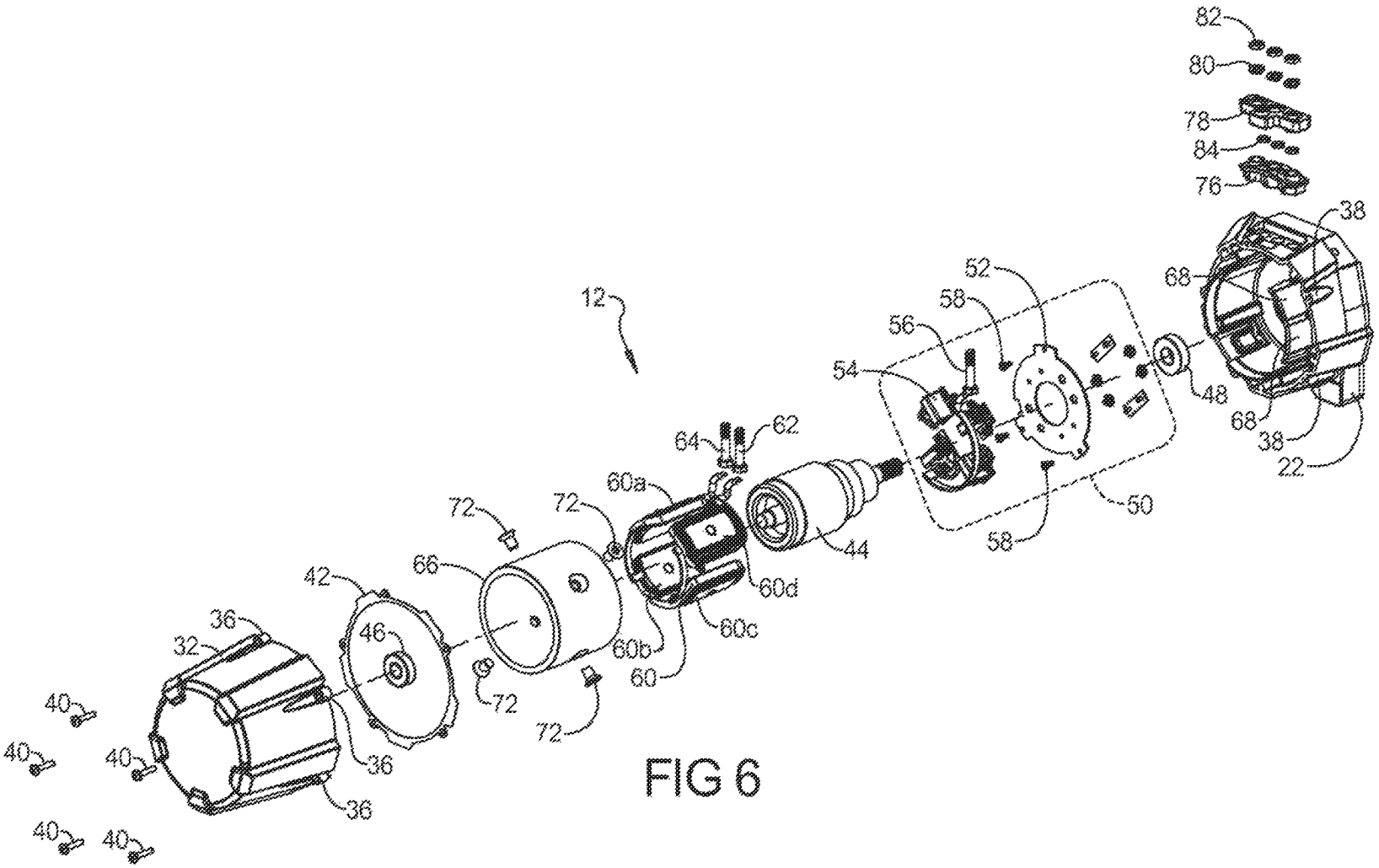
FIG. 6 is an exploded perspective view of the motor assembly according to the principles of the present disclosure.

With reference to FIGS. 4-10, the motor assembly 12 will now be described. The motor assembly 12 includes a housing 30 including a motor case 32 and the first drum support 22. The motor case 32 includes mounting bosses 36 and the first drum support includes corresponding mounting bosses 38. The mounting bosses 36, 38 each receive a fastener 40 for securing the motor case 32 to the first drum support 22. The gear unit case 28 and second drum support 24 can be assembled in a similar manner. A gasket 42, as shown in FIG. 6, can be disposed between the motor case 32 and the first drum support 22 to provide a sealed connection therebetween.

With further reference to FIG. 6, the motor assembly 12 includes an armature 44 rotatably supported within the motor case 32 by a bearing assembly 46 and rotatably supported by the first drum support 22 by a bearing assembly 48. A brush plate assembly 50 includes a brush plate 52 that supports a plurality of brushes 54 in contact with the armature 44. The brush plate assembly 50 is provided with a brush plate terminal 56 which is supported by the first drum support 22. The brush plate 52 can be mounted to the first drum support 22 by a plurality of grounding screws 58.

A field coil assembly 60 surrounds the armature 44 and includes field coil terminals 62, 64 which are also supported by the first drum support 22. The field coil assembly 60 is supported by a field coil flux ring 66 which is clamped between the motor case 32 and the first drum support 22. The field coil flux ring 66 can be supported by a plurality of ribs 68 extending from the first drum support 22 as well as internal ribs 70 (best shown in FIG. 5) of the motor case 32. Each of the field coils **60*a*-60*d* of the field coil assembly 60 is mounted to the field coil flux ring 66 by a corresponding fastener 72 so as to be supported in close proximity to the armature 44. The ribs 68 in the first drum support 22 protrude into the motor case 32 to create a secondary wall construction within the motor case 32 adding both rigidity and noise reduction. The motor case 32 can be made from aluminum, and the internal ribs 70, as well as the aluminum material that supports the field coil flux ring 66 and field coil assembly 60, allow for significantly improved heat dissipation from the coil assembly 60 into the motor case 32**.

Figure 8:
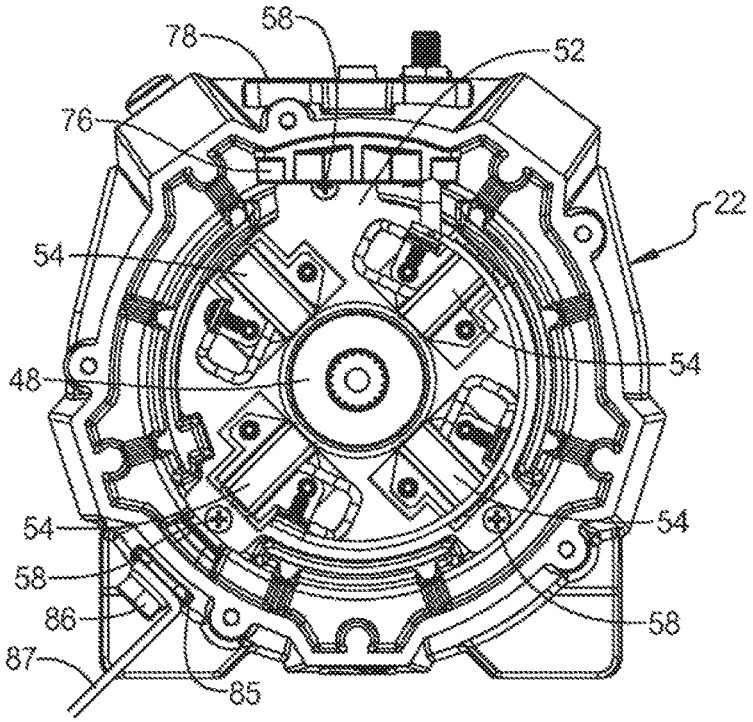
FIG. 8 is an end view of the drum support shown in FIG. 7.
Figure 9:
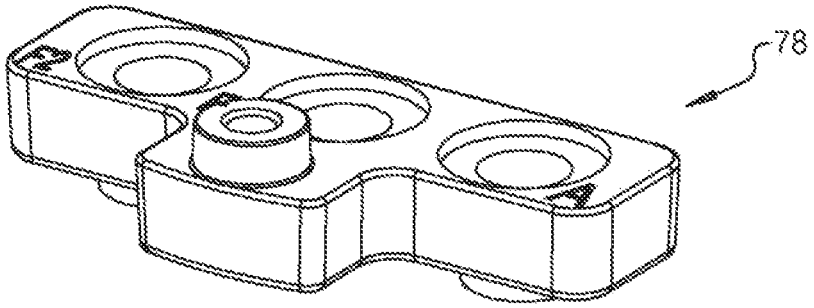
FIG. 9 is a perspective view of a top portion of a terminal isolator according to the principles of the present disclosure.
Figure 10:
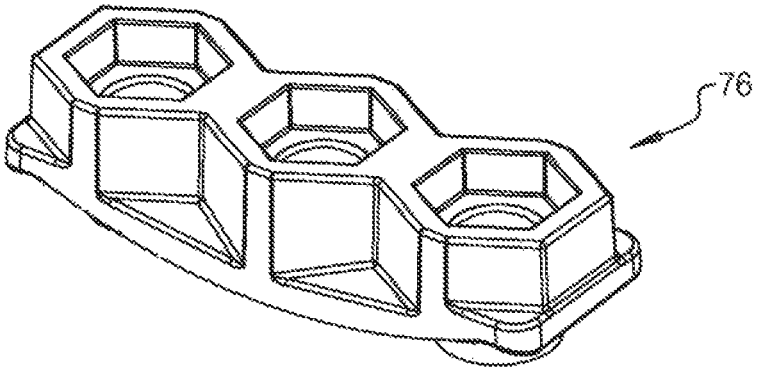
FIG. 10 is a perspective view of a bottom portion of the terminal isolator according to the principles of the present disclosure.

The field coil terminals 62, 64, as well as the brush plate terminal 56, are each disposed within the first drum support 22 and are electrically isolated therefrom by a bottom isolator 76 and a top isolator 78 which are shown in greater detail in FIGS. 10 and 9, respectively. A plurality of lock washers 80 and threaded nuts 82 are provided for securing the terminals 56, 62 and 64 to the isolators 76, 78. A plurality of O-rings 84 surround the terminals 56, 62, 64 between the top and bottom isolators 78, 76 to provide a seal around each terminal. As shown in FIG. 8, the first drum support 22 also includes a screw boss 85 for receiving a fastener 86 for connecting a battery ground cable 87 thereto.

Figure 7:
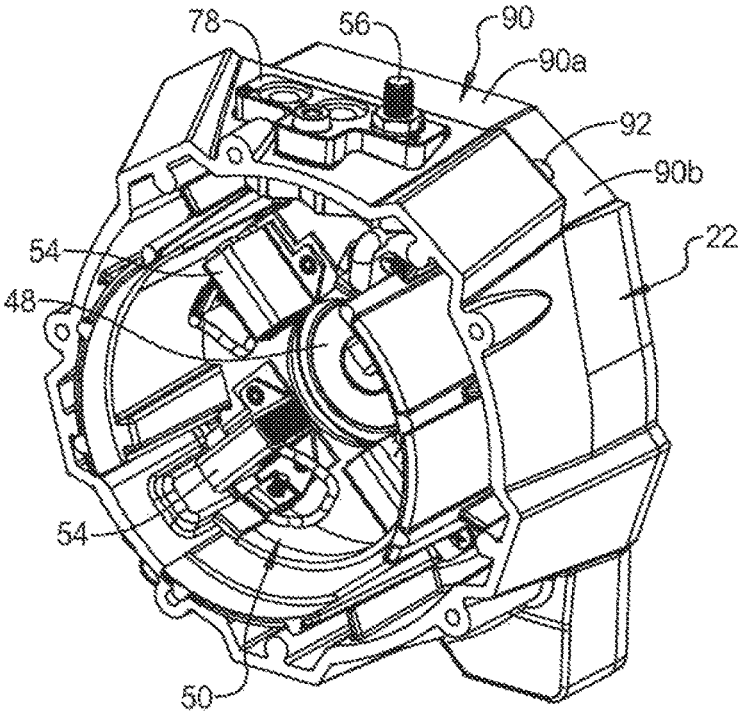
FIG. 7 is a perspective view of a drum support portion of the motor assembly according to the principles of the present disclosure.

As best shown in FIG. 7, the first drum support 22 supports the brush plate assembly 50 therein. The outer surface of the first and second drum supports 22, 24 are provided with a recessed region 90 that is designed to receive the tie plate 20 therein. The recessed region 90 includes an upper flat region 90*a* and two angled side portions 90*b* each including a mounting aperture 92 therein for receiving a threaded fastener 94 as best shown in FIGS. 1 and 2. The threaded apertures 92 can be aligned so as to intersect the rotational axis of the armature 44 and therefore provides good vertical and lateral support to the interconnection between the drum support 22 and tie plate 20.

Figure 3:
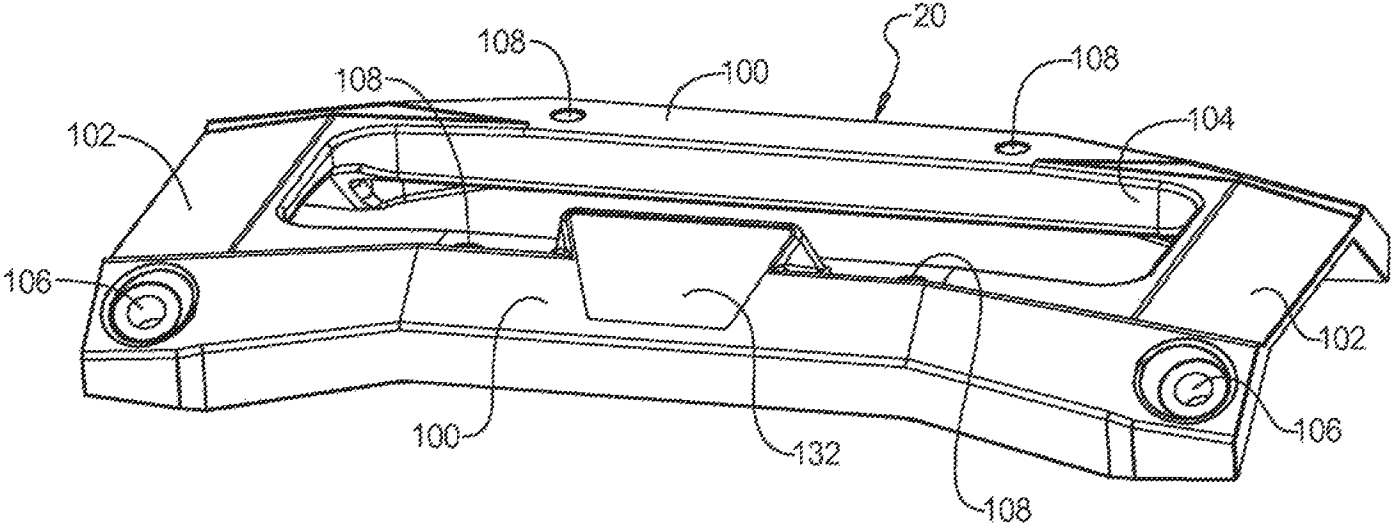
FIG. 3 is a perspective view of a tie plate for the winch according to the principles of the present disclosure.
Figure 4:
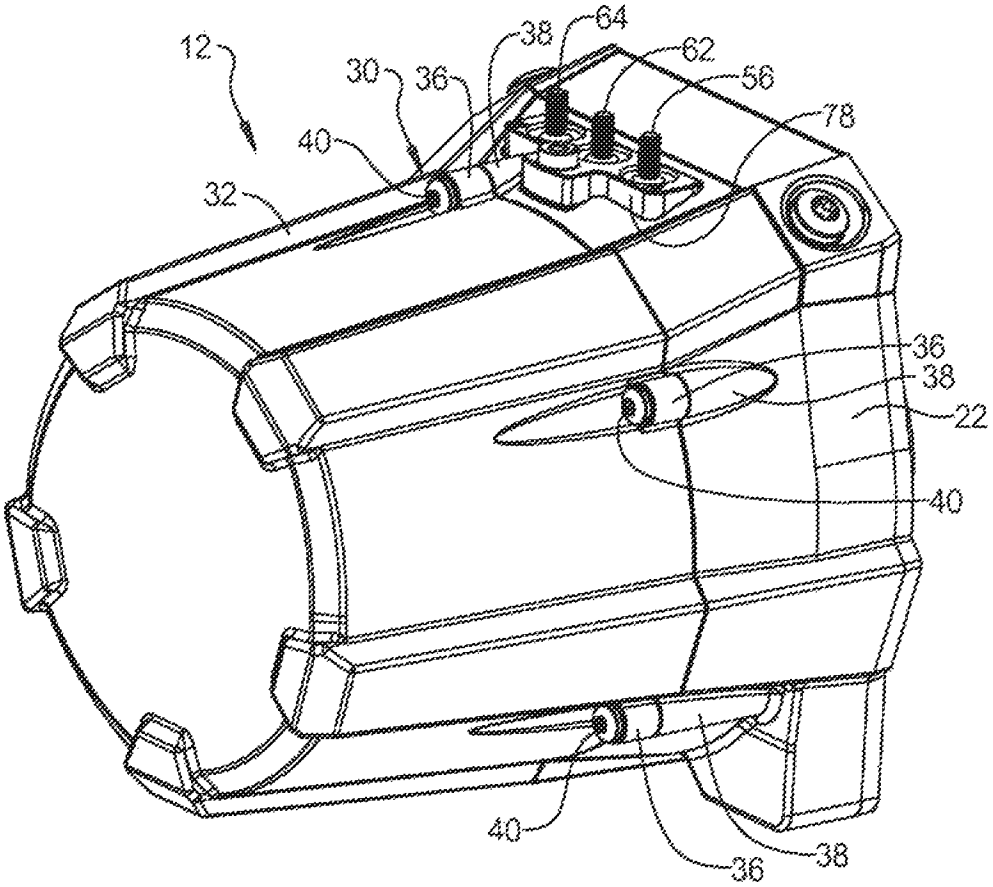
FIG. 4 is a perspective view of the motor assembly according to the principles of the present disclosure.
Figure 5:
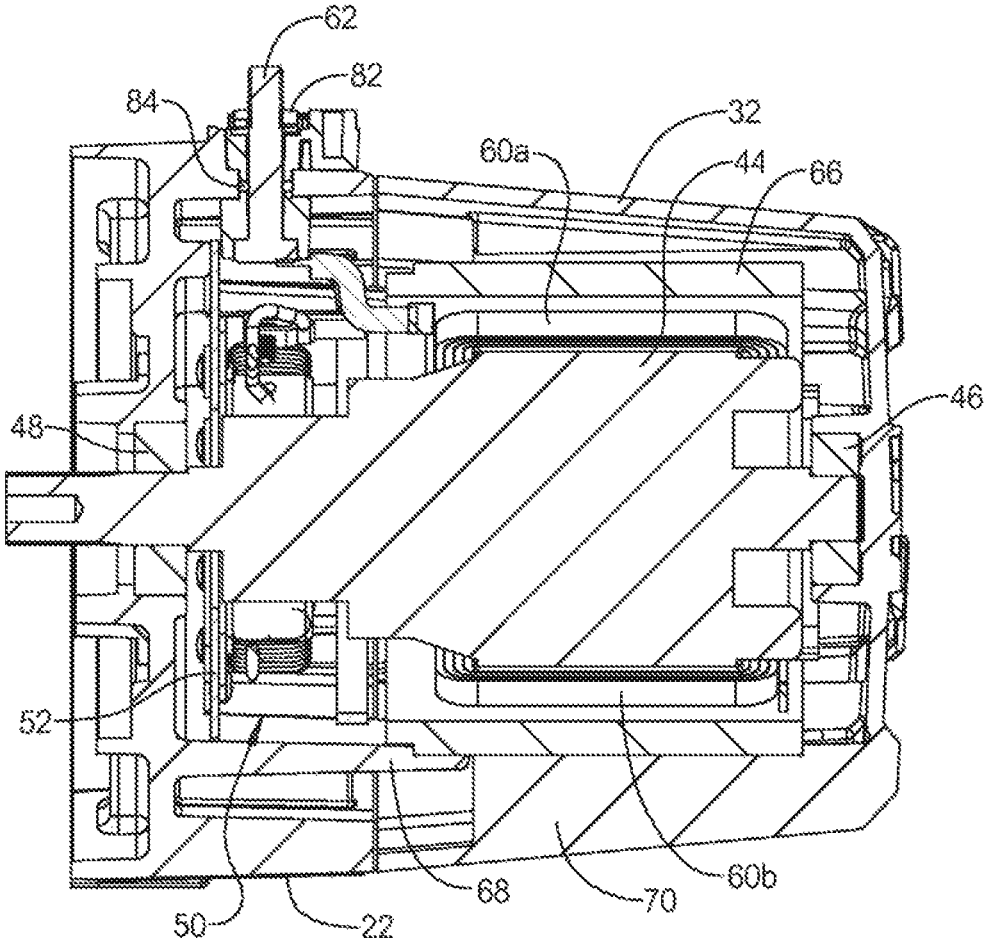
FIG. 5 is a cross-sectional view of the motor assembly shown in FIG. 4.

With reference to FIG. 3, the tie plate 20 includes a pair of elongated side rails 100 and a pair of connecting cross rails 102 that can define a central opening 104 therein. The cross rails 102 can be generally planar so as to lie flat against the flat portion 90*a* of the recesses 90 in the first and second drum supports 22, 24 which are part of the motor assembly 12 and gear reduction unit 14. The elongated side rails 100 can be angled relative to the cross bars 102 and include mounting apertures 106 at each end thereof that align with the threaded apertures 92 provided in the drum support 22 and receive the fasteners 94 therein. The tie plate 20 further includes a plurality of mounting apertures 108 that receive threaded fasteners (not shown) for securing the control unit 26 to the tie plate 20.

Figure 11:
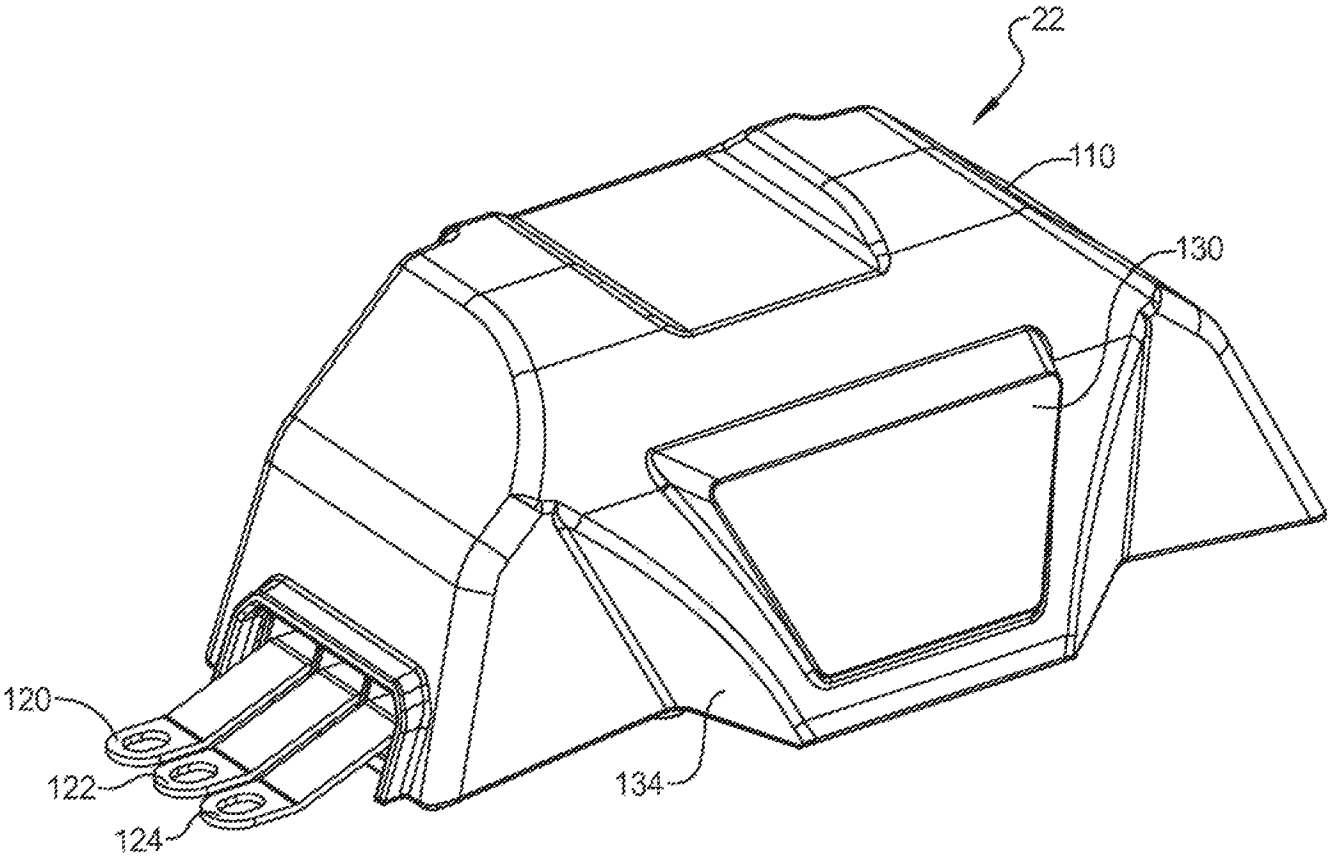
FIG. 11 is a perspective view of a control unit according to the principles of the present disclosure.
Figure 12:
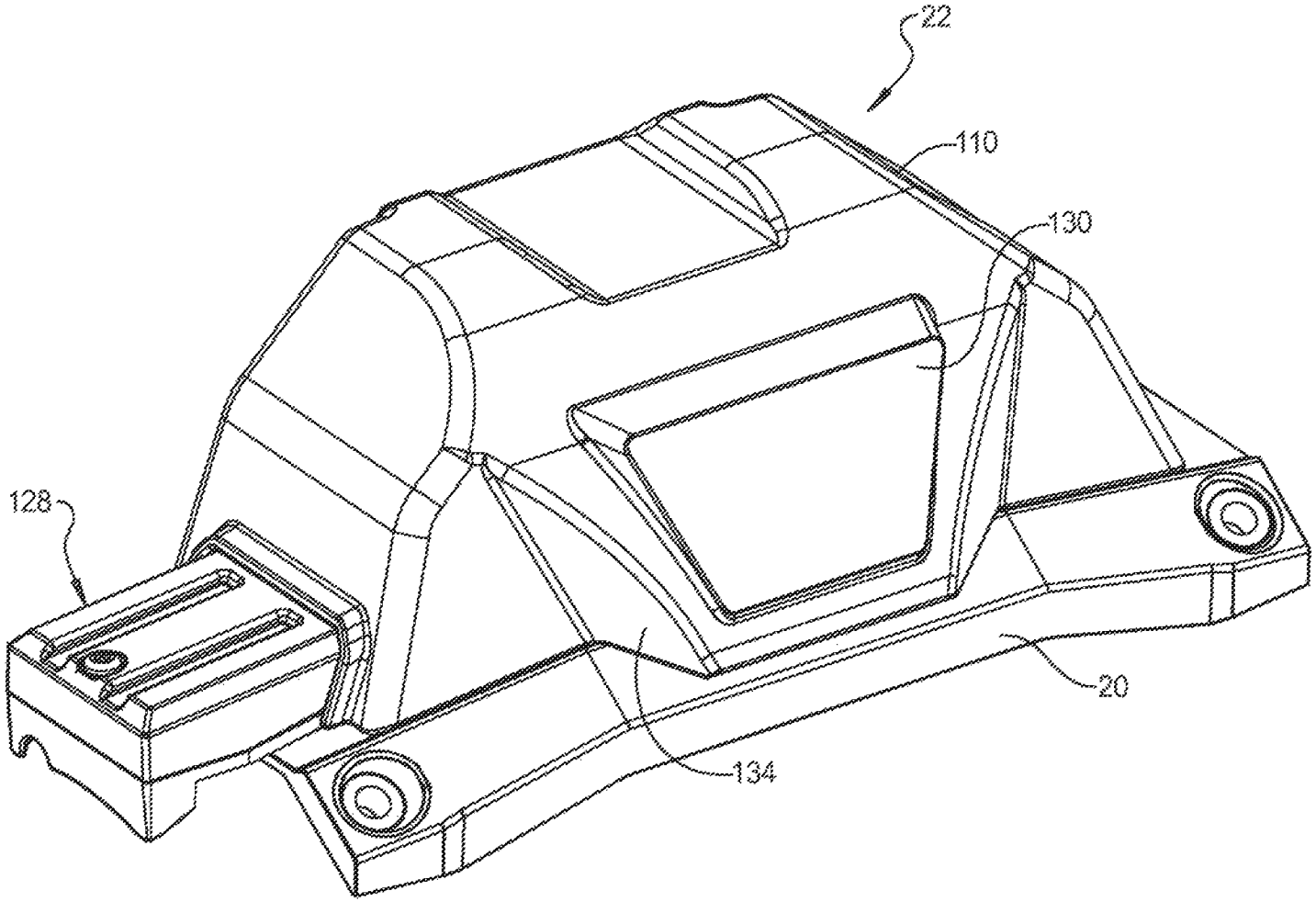
FIG. 12 is a similar perspective view of the control unit as shown in FIG. 11 with an added terminal cover.
Figure 13:
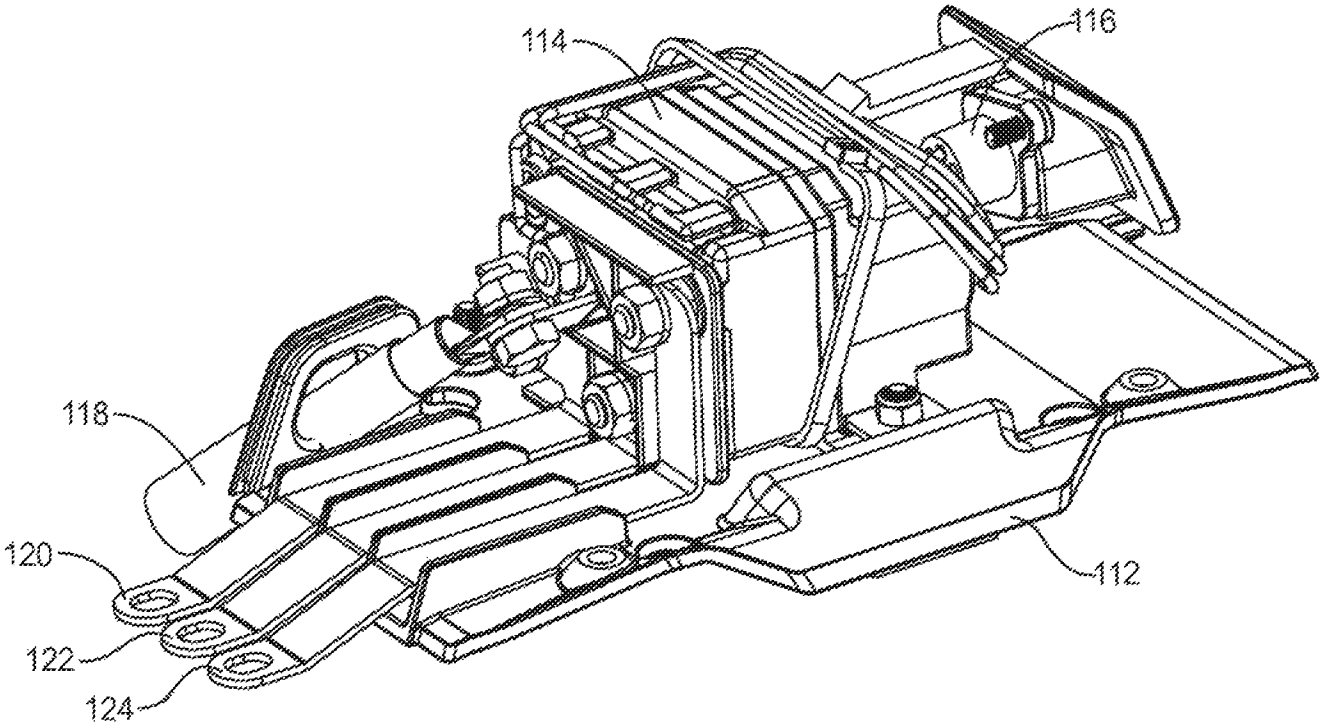
FIG. 13 is a perspective view of the control unit assembly with the cover removed according to the principles of the present disclosure.

With reference to FIGS. 11-13, the control unit 26 will now be described in further detail. As shown in FIG. 11, the control unit 26 includes a cover 110. As illustrated in FIG. 13, the control unit 26 includes a base plate 112 which supports a contactor 114 which can be of any known electrical contactor type such as solenoids, mosfets, or other types of known contactors. A remote connector 116 can be provided on the base plate 112 to allow a remote cable unit to be connected for activating the contactor 114. A power cable 118 is connected to the contactor 114 and a plurality of motor leads 120, 122, 124 are also provided in contact with the contactor 114. The motor leads 120, 122, and 124 serve as bus bars that connect the control unit 26 to the motor terminals 56, 62, 64. The motor leads 120, 122, 124, as well as the motor terminals 56, 62, 64, can be covered by an auxiliary cover 128, as best shown in FIG. 12. As an alternative configuration, the control unit 26 can be removed from the tie plate 20 and mounted to an alternative portion of a vehicle, such as a bumper, fender, or other external or internal compartment of the vehicle, in order to provide a winch having a lower profile, as illustrated in FIG. 2. In the case where the control unit 26 is mounted in a different location, the motor leads 120, 122, 124 can be replaced with cables that provide connections between the remotely located control unit 26 and the motor terminals 56, 62, 64.

The cover 110 of the control unit 26 is provided with a branding 130 such as the company or product name or a logo and the tie plate 20 also includes a branding 132. When the control unit 26 is assembled to the tie plate 20, the cover 110 has a protruding portion 134 that extends over top of the branding 132 on the tie plate 20, as shown in FIG. 12. When the control unit 26 is removed, the branding 132 on the tie plate 20 is then exposed so that there is always a branding 130 or 132 visible regardless of whether the control unit 26 is assembled to the tie plate or not.

In operation, a remote control unit connected to the remote connector 116 can be used to provide control signals to the contactor 114 for providing current to the motor assembly 12 to spool in or spool out the cable 18 from the drum 16. The winch 10 can be provided with a brake mechanism interior or exterior to the drum 16, and the gear reduction unit 14 can include multiple planetary gear sets, as is generally known in the art.

Figure 14:
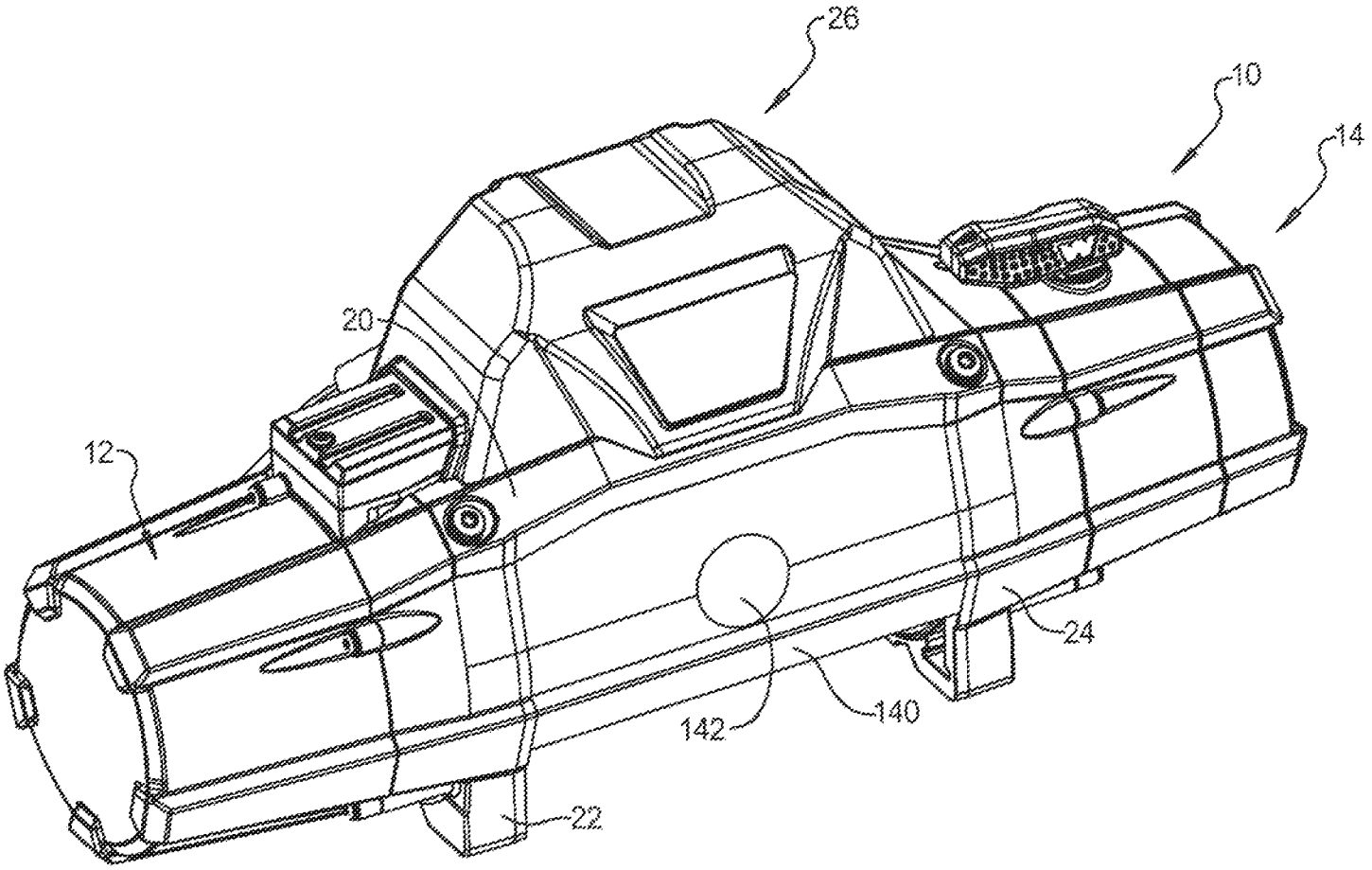
FIG. 14 is a perspective view of the winch having a rope cover mounted thereto according to the principles of the present disclosure.
Figure 15:
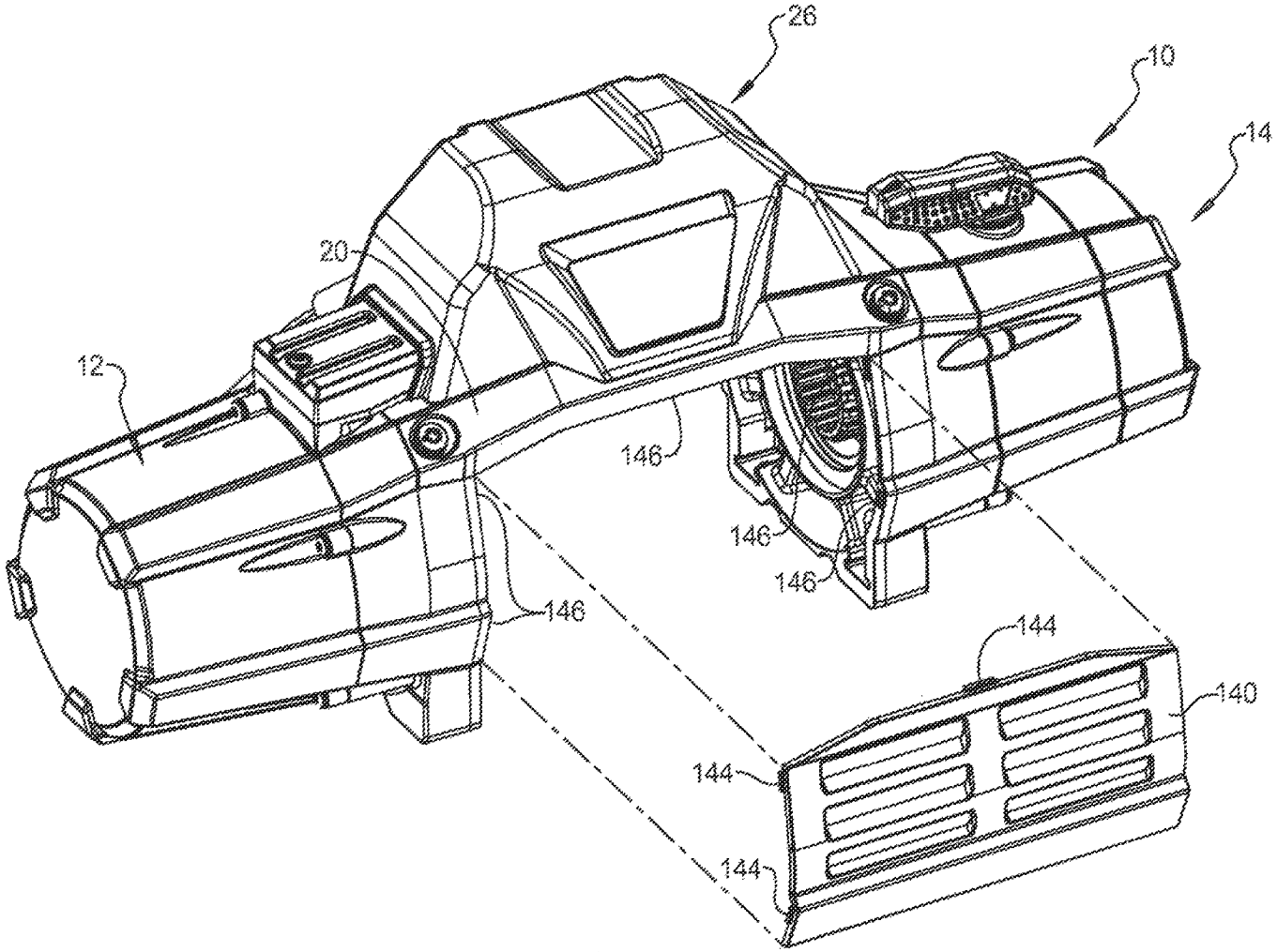
FIG. 15 is a perspective view of the winch with an alternative rope cover removed for illustrative purposes.

As illustrated in FIGS. 14 and 15, a rope cover 140 can be mounted to the front of the winch 10 when the winch 10 is not in use to shield the rope or cable and the drum from UV light and debris that can degrade the rope or cable. The rope cover 140 can also have a refined appearance to enhance the appearance of the winch 10 when it is not in use. The rope cover 140 has a platelike structure and can include a branding 142, as shown in FIG. 14. As an alternative, as shown in FIG. 15, the cover plate 140 can have alternative features such as ribs, slots, louvers, openings, or other features to give a refined appearance. The rope cover 140 further includes retention features 144 that engage corresponding retention features 146 provided on the first and second drum supports 22, 24 and/or the tie plate 20. Although they can take on various other forms, the retention features 144, 146 are shown as protrusions or fingers 144 and recesses or slots 146. The protrusions or fingers 144 can extend from edges of the rope cover 140 and the recesses or slots 146 can be provided in the surface of the drum supports 22, 24 and the tie plate 20. The protrusions or fingers 144 can be snapped into the recesses or slots 146 for retaining the rope cover 140 in place on the winch 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A winch, comprising:

a motor having a motor housing including a motor case and a first drum support coupled to the motor case for closing an end of the motor case;

a rotatable drum;

a gear reduction unit drivingly attached to the motor, the gear reduction unit including multiple planetary gear sets and having a gear housing including a gear case and a second drum support attached to the gear case for closing an end of the gear case; and three motor terminals linearly aligned with one another along a top side of the motor housing, vertically above the motor and protruding through a top side of the first drum support, and, where the three motor terminals electrically couple the motor to a control unit of the winch.

2. The winch of claim 1, further comprising an auxiliary cover covering and positioned over the three motor terminals.

3. The winch of claim 1, further comprising a seal positioned around each of the three motor terminals.

4. The winch of claim 3, wherein the seal is an O-ring.

5. The winch of claim 1, further comprising an isolator positioned between the motor housing and the three motor terminals.

6. The winch of claim 1, further comprising a brake positioned exterior to the rotatable drum.

7. The winch of claim 1, wherein the rotatable drum is positioned between the gear reduction unit and the motor.

8. The winch of claim 1, wherein the three motor terminals extend outward from an outer surface of the top side of the motor housing, in a direction away from a center of the winch.

9. The winch of claim 1, wherein the motor case includes a plurality of ribs adapted to cool the motor.

10. A winch, comprising:

a motor having a motor housing including a motor case and a first drum support coupled to the motor case for closing an end of the motor case;

a gear reduction unit drivingly attached to the motor and having a gear housing including a gear case and a second drum support attached to said gear case for closing an end of said gear case;

a rotatable drum drivingly connected to the motor and supported by the first and second drum supports;

a tie structure including two side rails extending across a length of the drum, directly above the drum, and connecting the first and second drum supports to one another;

a control unit removably mounted above the drum and directly to the two side rails; and three motor terminals coupled to a top surface of the motor housing, wherein the three motor terminals are positioned in a line perpendicular to an axis of rotation of the rotatable drum.

11. The winch of claim 10, further comprising an auxiliary cover positioned over and covering the three motor terminals.

12. The winch of claim 10, wherein the control unit includes motor leads coupled to the three motor terminals and wherein the motor leads electrically couple the control unit to the three motor terminals, where the three motor terminals are electrically coupled to the motor.

13. The winch of claim 10, further comprising a brake positioned external to the drum.

14. The winch of claim 10, further comprising a rope wound around the drum and an opening between one of the two side rails and a bottom of the winch, where the opening is positioned in front of the drum.

15. A winch, comprising:

a motor having a motor housing including a motor case and a first drum support coupled to the motor case for closing an end of the motor case;

a gear reduction unit drivingly attached to the motor and having a gear housing including a gear case and a second drum support attached to said gear case for closing an end of said gear case;

a rotatable drum drivingly connected to the motor and supported by the first and second drum supports, where the drum is positioned between the motor and the gear reduction unit;

two side rails extending across a length of the drum, above the drum, and connecting the first and second drum supports to one another;

three motor terminals coupled to a top surface of the motor housing, the three motor terminals linearly aligned with one another along the top surface;

a brake positioned external to the drum; and an opening formed between one of the two side rails and a bottom of the winch, where the opening is positioned in front of the drum.

16. The winch of claim 15, further comprising a control unit removably mounted directly above the drum to the two side rails and wherein the three motor terminals electrically couple the motor to the control unit.

17. The winch of claim 15, further comprising an auxiliary cover positioned over and covering the three motor terminals.

18. The winch of claim 15, further comprising a rope wound around the drum, where the rope extends out of the opening.

19. The winch of claim 15, wherein an end of the motor case positioned away from the first drum support and an end of the gear case positioned away from the second drum support are narrower than the first and second drum supports.

* * * * *